United States Patent [19]

Genaro et al.

[11] Patent Number: 4,629,276

[45] Date of Patent: Dec. 16, 1986

[54] MULTIDIRECTION CONNECTOR HOUSING

[75] Inventors: Donald M. Genaro, Hayworth, N.J.; Chris G. Johnson, New York, N.Y.; Alvin R. Tilley, Middletown, N.J.

[73] Assignee: Henry Dreyfuss Associates, New York, N.Y.

[21] Appl. No.: 774,551

[22] Filed: Sep. 10, 1985

[51] Int. Cl.[4] ..... H01R 13/58

[52] U.S. Cl. ..... 339/103 R; 339/103 B; 339/105; 339/107

[58] Field of Search ..... 339/103 R, 103 M, 103 B, 339/105, 107

[56] References Cited

U.S. PATENT DOCUMENTS

| | | | |
|---|---|---|---|
| 3,958,300 | 5/1976 | Tanaka | 339/103 B X |
| 4,034,944 | 7/1977 | Moran | 339/103 B X |
| 4,421,376 | 12/1983 | Cosmos et al. | 339/103 M |
| 4,549,780 | 10/1985 | Bertini et al. | 339/107 |

FOREIGN PATENT DOCUMENTS

| | | | |
|---|---|---|---|
| 1391879 | 4/1975 | United Kingdom | 339/103 M |

*Primary Examiner*—Eugene F. Desmond
*Attorney, Agent, or Firm*—Morgan & Finnegan

[57] ABSTRACT

A multidirection connector housing for an electronic plug assembly comprises a body portion, a strain relief portion and a locking mechanism for locking the body portion and the strain relief portion together in at least seven orientations with respect to a connector plug. The plane formed at the intersection of the body portion and the strain relief portion is aligned at substantially 45° to the longitudinal axis of the body portion. The strain relief portion includes an internal cable passageway providing substantially 45° of turn. The profiles of the strain relief portion and body portion locking members are preferably square. Preferred embodiments provide ready interchange of cable orientations.

14 Claims, 17 Drawing Figures

MULTIDIRECTION CONNECTOR HOUSING

BACKGROUND OF THE INVENTION

The invention pertains to electronic connector plugs. More particularly, the invention pertains to a housing unit shielding the junction between an electronic connector plug and an associated cable.

With the advent of the electronics industry, there have come to be known a variety of electronic plug connectors and housing units which provide an interface between a signal carrying cable and an electronic plug connector. One such type of known electronic plug connector is the "D" type series connector 101, an example of which is illustrated in FIG. 1.

The prior known connectors generally include a rearwards facing cable receiving portion 103 including a plurality of inputs 119 for receiving cable wires or strands. There are typically also provided in known connectors, about the rear portions thereof, fastening means 105 for securing a cable brace or plug assembly 115 (FIG. 2) having holes 117 adapted for receiving a screw to the connector 101.

Once the cable and plug assembly 113/115 is secured to the plug connector 101, the connector unit may be plugged in to an electronic device (not shown) by inserting the forward portion comprising male connector pins 107 in to the plug receiving portion of the electronic device. Grippers 109 (FIG. 1), which may be releasable via mechanical linkage associated with side push buttons 111, may serve to retain the plug connector in place when the plug is coupled to the electronic device.

As FIG. 2 illstrates, in the known plug connectors of the prior art, when the electrical or electronic cable 113 is coupled to the plug connector unit, the path of the cable 113 is predominately straight back from the plug connector in the longitudinal direction. Since electronic cable is quite often semi-rigid and of a thick density (e.g. $\frac{3}{8}$ inches and above in diameter), little cable bend is afforded in the area immediately behind the connector. Thus, with the prior art connectors, considerable cable strain often results from trying to bend the cable in tight spaces.

In addition, the plug connector unit itself requires some vertical space. This, quite often when using plug connectors of the prior art, considerable space is required to be reserved about the rear of the electronic device to accommodate the vertical lengths of the plug connector and the cable. The aforementioned plug connectors of the prior art thus place unwanted restrictions on electronic equipment space and design features.

Furthermore, since it is generally expected that plug connectors such as the type illustrated in FIGS. 1 and 2 are quite often used in electronic devices such as computers, the electronic connector must be safe, preventing the user from experiencing electric shock, and must be reliable, providing securable fastenings between the cable and the plug components.

It is therefore an object of the invention to provide an electronic plug connector housing which eliminates the space and design restrictions associated with rigid rear exiting plug connectors of the prior art.

It is a further object of the invention to provide an electronic plug connector housing which is easily user adjustable and manipulatable and satisfies the design needs of the user.

It is a further object of the invention to provide an electronic plug connector which meets high standards of strength, safety and reliability while being fully user manipulatable.

SUMMARY OF THE INVENTION

These and other objects of the invention are met by providing a multidirection plug connector housing comprising a body portion, a strain relief portion, and means for locking the body portion and the strain relief portion together in a plurality of orientation. The plane formed at the intersection of the body portion and the strain relief portion is aligned at substantially 45° to the longitudinal axis of the body portion. A cable passageway within the strain relief portion provides substantially 45° of turn. Locking means provided between the strain relief portion and the body portion comprise square profiles whereby the strain relief portion may be positioned in any of four orientations with respect to the body portion. In preferred embodiments, the body portion and the strain relief portion are divided horizontally in half, the half portions being secured by releasable fasteners. In preferred embodiments, at least seven orientations of cable exit are provided.

BRIEF DESCRIPTION OF THE DRAWINGS

The invention will be described more fully below by way of reference to the following drawings, in which:

FIGS. 6A–9A are further illustrations of cable orientations achievable in a multidirection plug connector according to the invention;

DETAILED DESCRIPTION OF THE DRAWINGS

Figure 3:
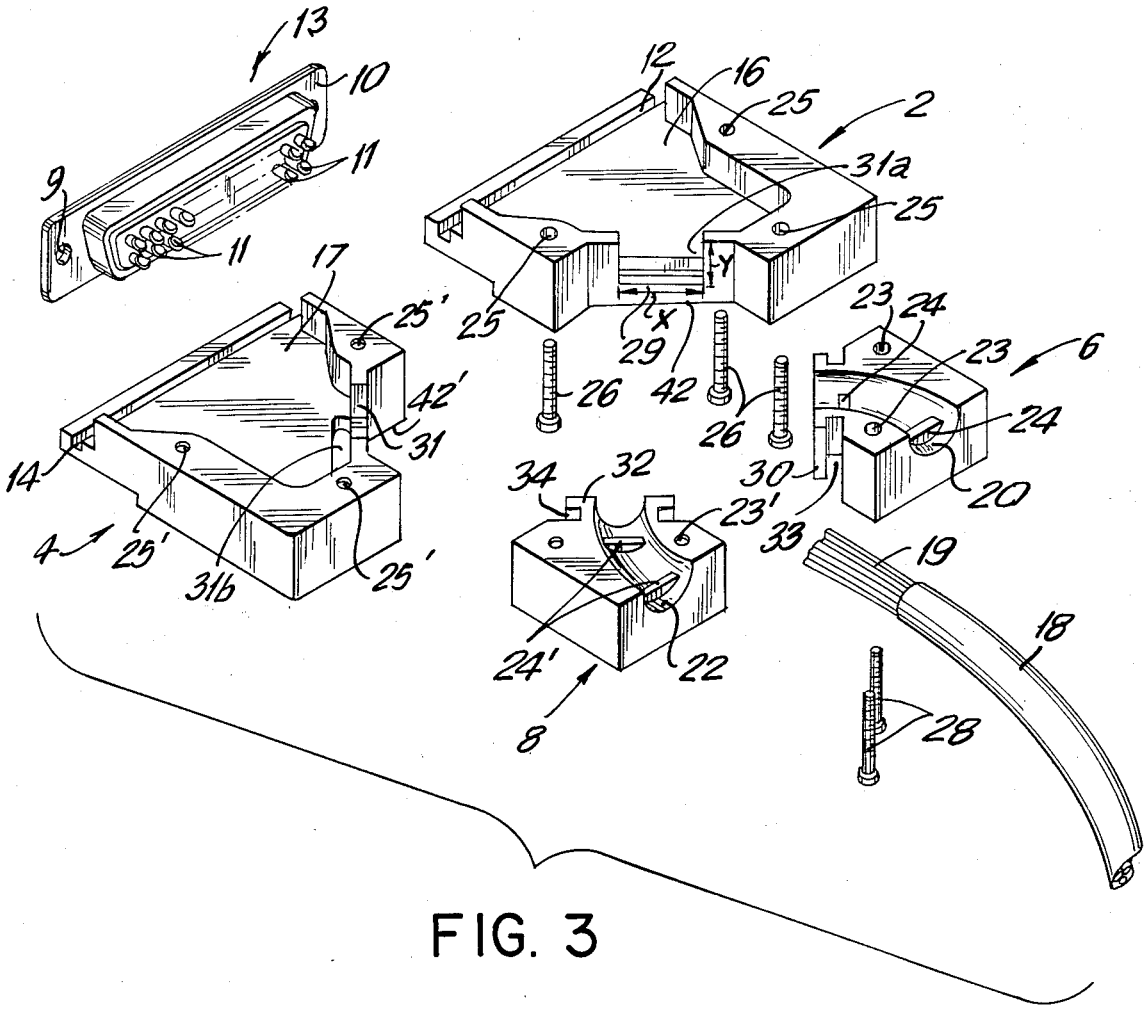
FIG. 3 is an exploded perspective drawing of a multidirection plug connector according to the invention and further illustrating a cable portion and a electronic plug.

FIG. 3 illustrates an exploded perspective view of a multidirection connector according to the invention for adjustably and securely connecting or housing the connection between a cable 18 and an electronic plug 13. The embodiment illustrated includes a first body portion hemisphere 2 and a second body portion hemisphere 4. First and second body portions 2, 4 may be structurally similar, in this embodiment being mirror images of one another. The body portion hemispheres 2, 4 define, in part, cut-out portions 16, 17 which provide fanning or resting areas for the cable end wires or strands 19. At the extreme forward end of the body hemisphere portions 2, 4 there are provided retaining grooves 12, 14 for receiving the connector flange 10 of a plug 13.

As will be seen further below, first body hemisphere portions 2 and second body hemisphere portion 4 may be provided with fastening holes 25, 25' which may be aligned to receive user adjustable and removable fastening means, such as screws 26, for securing together the two hemisphere portions.

Assuming that the orientation of plug 13 is stationary, it will be understood that the body portion 3 (see FIG. 5) comprising first and second body hemisphere portions 2, 4 may retain electronic plug 13 within grooves 12, 14 such that first body portion 2 is above second body portion 4. Further, it will also be readily understood that the body portion 3 may be arranged with respect to fixed plug 13 such that second hemisphere portion 4 is above first hemisphere portion 2. In other words, the body portion 3 may assume two orientations respective the plug 13.

It will be seen that the profiles of the first and second body hemisphere portions 2, 4 are substantially rectangular in the horizontal plane with substantially prism-shaped cut-outs 42, 42' taken therefrom at corresponding, mating corners as illustrated in FIG. 3.

First and second body hemisphere portions 2, 4 further comprise semi-square female receiving portions 29, 31 at the midpoint of the respective substantially prism-shaped cut-out portions 42, 42'. In preferred embodiments, the horizontal component X of the semi-square cut-out 29 will be twice the length of the vertical component Y.

First and second body hemisphere portions 2, 4 further provide retaining grooves 31A, 31B substantially between cable resting or fanning areas 16, 17 and receiving portions 29, 31 for receiving and retaining male flange portions 30, 32 of first and second strain relief hemisphere portions 6, 8 which are also illustrated in FIG. 3.

First and second strain relief portion hemispheres 6, 8 define semi-cylindrical cable passageways 20, 22 which preferably include 45° of bend along the length thereof. Cable grips 24, 24' provided within cable passageways 20, 22 prevent slippage of cable 18 when the strain relief hemispheres 6, 8 are secured about the cable 18 (See FIG. 4).

To secure the cable 18 within the strain relief portion hemisphere 6, 8, the cable is placed within passageway 20, 22. Respective fastener holes 23, 23', provided within the strain relief hemispheres 6, 8, are then aligned for receiving preferrably user adjustable and removable fastening means such as screws 28. Fasteners 28 may then be inserted within holes 23, 23'.

It will be readily understood that, when the strain relief hemisphere portions 6, 8 secured about the cable 18, the strain relief portion 1 will absorb and relieve the physical strain associated with bending the cable 18 through the 45° turn of passageway 20, 22.

First and second strain relief portions 6, 8 further include locking and connecting male portions 30, 32 having semi-square perimeter profiles which, when joined, define the square perimeter of strain relief portion locking member 37.

The male locking and connecting portions 30, 32 (FIG. 3) are extended from the main of the strain relief hemispheres 6, 8 such that circumferential grooves 33, 34 are defined therebetween. When the hemispheres 6, 8 of strain relief portion 1 (FIG. 4) are joined, a square circumferential groove 35 is thus formed between locking members 37 and the main of strain relief portion 1.

Figure 4:
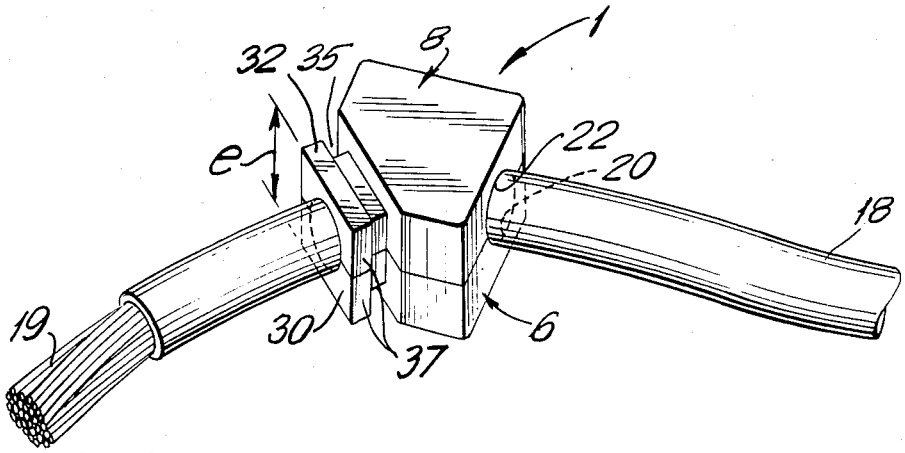
FIG. 4 is a perspective drawing of a strain relief portion of an apparatus according to the invention retaining a cable portion.

FIG. 4 illustrates strain relief portion 1 comprising strain relief hemispheres 6, 8 secured together via fasteners 28 (FIG. 3). A cable 18, including individual cable wires or strands 19 is shown in FIG. 4 illustratively passing through cable passageway 20, 22 of strain relief portion 1.

Figure 5:
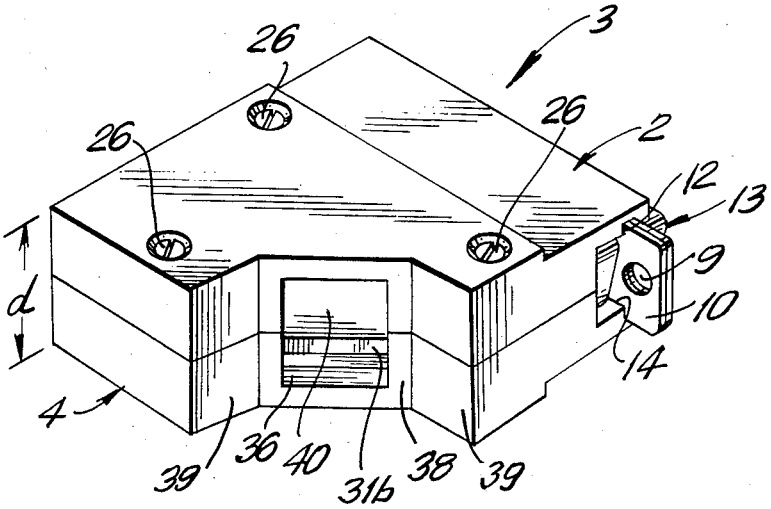
FIG. 5 is a rear perspective drawing of a body portion of a multidirection connector according to the invention.

FIG. 5 illustrates connector body portion 3 comprising body portion hemispheres 2, 4. Fasteners 26 are illustrated securing together body portion hemispheres 2, 4. Plug 13 is illustrated retained within retaining grooves 12, 14.

With the body portion fasteners 26 removed, first body portion hemisphere 2 may be spaced apart from second body portion hemisphere 4 whereby the forward male locking member 37 (FIG. 4) of strain relief portion 1 may be inserted through the substantially square female receiving window 40 of the body portion 3 (FIG. 5) in any of the four orientations illustrated in FIGS. 6–9.

As stated above, in preferred embodiments, the profile of the locking and retaining male member 37 of strain relief portion 1 (FIG. 4) is substantially square and spaced apart from the main of the strain relief portion 1 such that a circumferential square groove 35 is defined therebetween. The outer perimeter of the forward mating and locking portion or flange 37 will preferably be of a greater dimension than the perimeter 36 defining the body portion female receiving window 40, such that the locking portion (flange) 37 will be retained behind body portion cut-out wall 38. Further, the length e (FIG. 4) of any side of the preferably square locking flange 37 of strain relief portion 1 will preferably be less than the height d of the body portion 3 (FIG. 5) to allow for the flange 37 to be retained within body portion 3. When secured within the body portion 3, the flange 37 of the strain relief portion 1 will rest in seating grooves 31A, 31B shown in FIG. 3 and FIG. 5. As illustrated in FIG. 5, back corner walls 39 of body portion 3 partially define the prism-shaped cut-outs 42, 42' discussed above with regards to FIG. 3.

Figure 8:
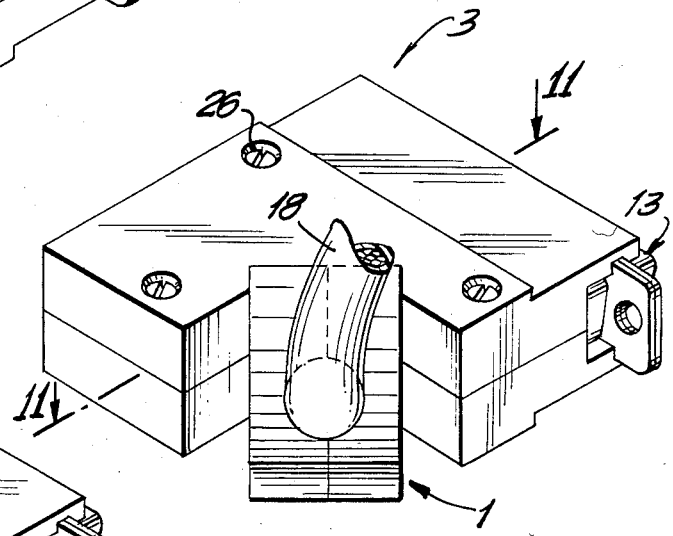
Figure 9:
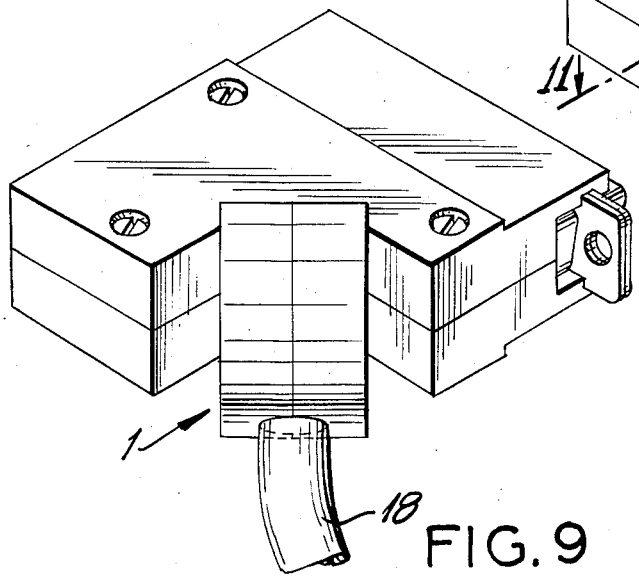
Figure 7A:
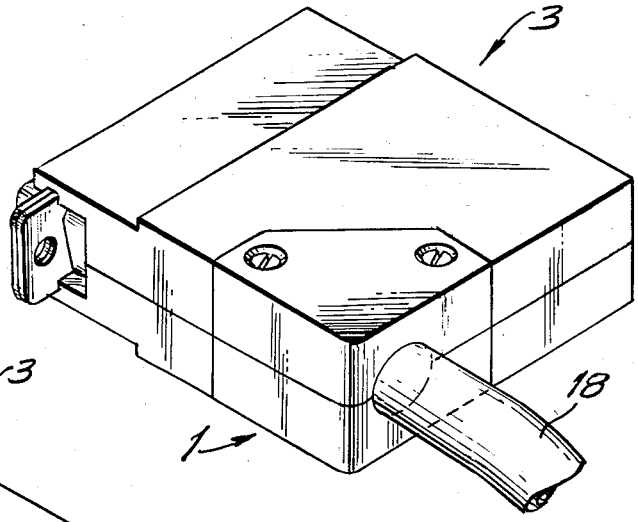
Figure 8A:
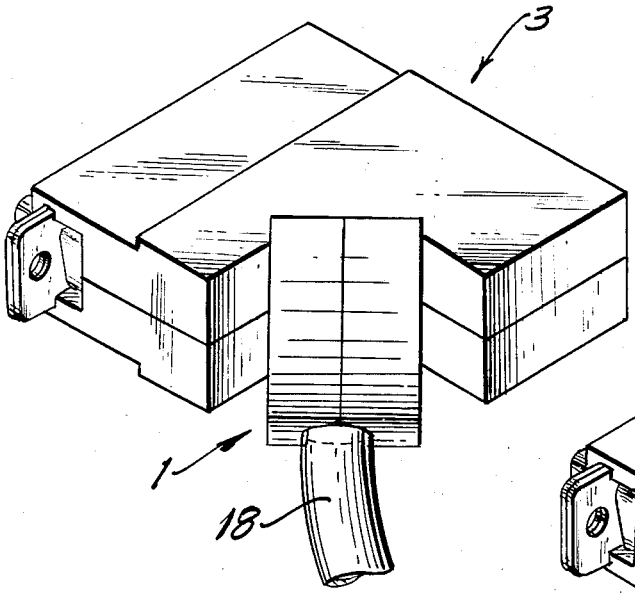
Figure 9A:
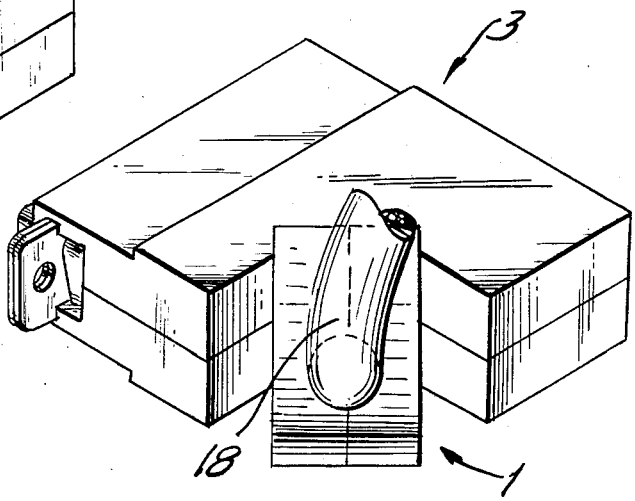

It should be appreciated that due to the substantially square profiles of the body and strain relief mating portions 40, 37 illustrated in FIGS. 4 and 5, that any of the four cable orientations illustrated in FIGS. 6–9 may be readily achievable with an apparatus according to the invention. Thus, as the strain relief male mating portion 37 is rotated from 0° (FIG. 6) to 90° (FIG. 8) to 180° (FIG. 7) to 270° (FIG. 9) within female body receiving portion 40, the cable 18 will exit from the strain relief portion 1 in four orientations, to the right (FIG. 6), straight back (FIG. 7), upwards to the right 45° (FIG. 8) and lower to the right 45° (FIG. 9). Likewise, since the body portion 3 may be oriented in any of two positions with respect to the plug 13, i.e. with the cut out portion 42, 42' (FIG. 3) to the right or to the left, the orientations of FIGS. 6A–9A may also be readily achievable. Thus, in FIG. 6A the cable exits to the left; in FIG. 7A the cable exits staight back; in FIG. 8A the cable exits down to the left 45°; and in FIG. 9A the cable exits up to the left 45°.

With an embodiment according to the invention, it will thus be readily understood that a cable 18 may assume at least seven different orientations as it exits from the connector assembly: right, left, straight through, upper left (45°), upper right (45°), lower left (45°), and lower right (45°). Fewer or greater numbers of cable orientations may be provided by changing the profile or the number of sides on the strain relief locking member 37 and the body portion receiving window 40.

Figure 6:
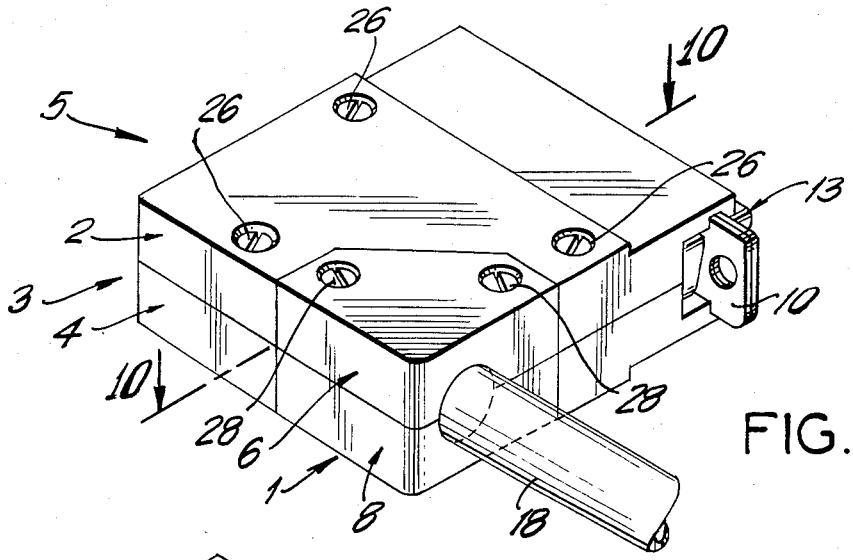
FIGS. 6–9 are perspective drawings illustrating different cable orientations achievable with a multidirection plug connector according to the instant invention.
Figure 7:
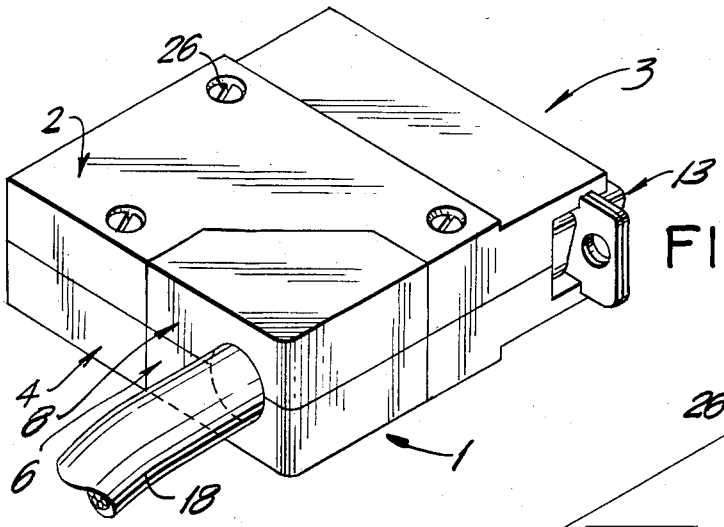
Figure 6A:
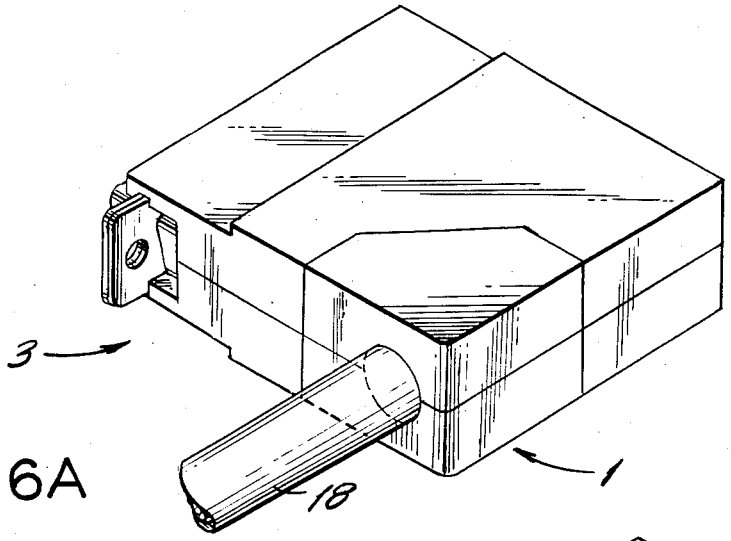
Figure 10:
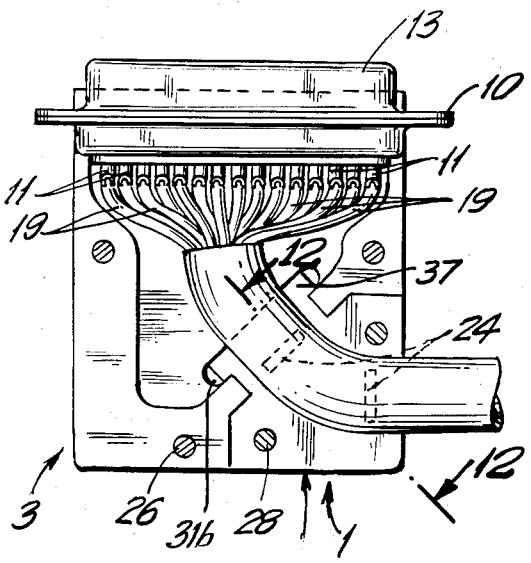
FIG. 10 is a partially cut-away plan view taken along line 10—10 of FIG. 6.

FIG. 10 is a partial cut-away illustration taken along the line 10—10 of FIG. 6. FIG. 10 illustrates a cable 18 passing through strain relief portion 1 and being secured therewithin by grippers 24. At the end of cable 18 there are illustrated cable wires 19 welded or otherwise secured to respective receiving pins or connectors 11. The strain relief locking member (flange) 37 of strain relief portion 1 is illustrated resting in body portion retaining groove 32B. As may be seen in the embodiments of FIGS. 6 and 10, the strain relief portion 1 may be oriented with respect to the body portion 3 such that the cable 18 existing from the strain relief portion 1 exits to the right side of the connector assembly 5 with respect to the plug 13.

Figure 11:
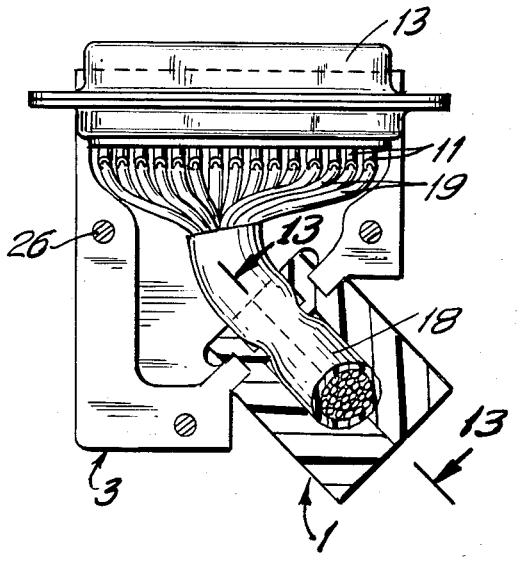
FIG. 11 is a partially cut-away plan view taken along the line 11—11 of FIG. 8.

Likewise, in the embodiment illustrated in FIG. 11, which illustrates a partial cross-sectional view taken along the line 11—11 of FIG. 8, the strain relief portion may be oriented with respect to the body portion 3 such that the cable 18 exits at a substantially 45° angle from the upper right of the plug connector 5 with respect to the plug 13.

Figure 12:
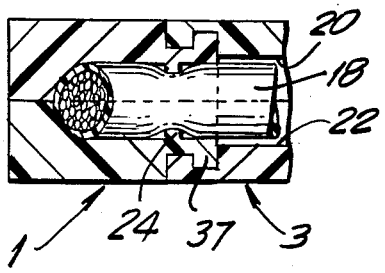
FIG. 12 is a partial cross-sectional view taken along the line 12—12 of FIG. 10.

FIG. 12 is a cross-sectional view taken along the line 12—12 of FIG. 10 and illustrates the cable 18 bending within strain relief portion passageway 20, 22. Note that the forward locking portion 37 of strain relief portion 1 is locked in place within connector body portion 3. Cable strain caused by the 45° bend of cable 18 is absorbed primarily within strain relief portion 1 and may be further transferred to body portion 3 through locking portion 37.

Figure 13:
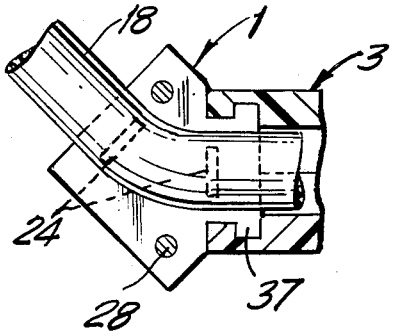
FIG. 13 is a partial cross-sectional view taken along the line 13—13 of FIG. 11.

FIG. 13, which is taken along the line 13—13 of FIG. 11, illustrates that with an embodiment according to the invention, although the strain relief portion 1 may be oriented in plurality of ways with respect to the body portion 3, the mating of the strain relief portion 1 within the body portion 3, and the 45° bend of the cable 18, are maintained.

Figure 1:
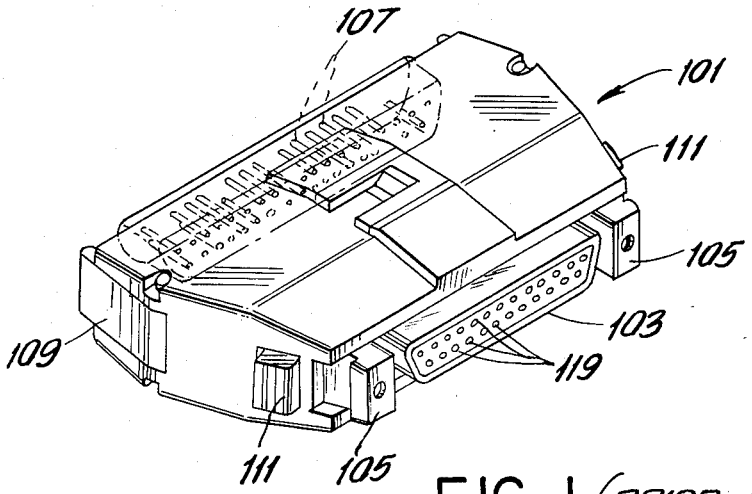
FIG. 1 (PRIOR ART)
FIG. 1 is a perspective illustration of a electronic plug connector of the prior art.
Figure 2:
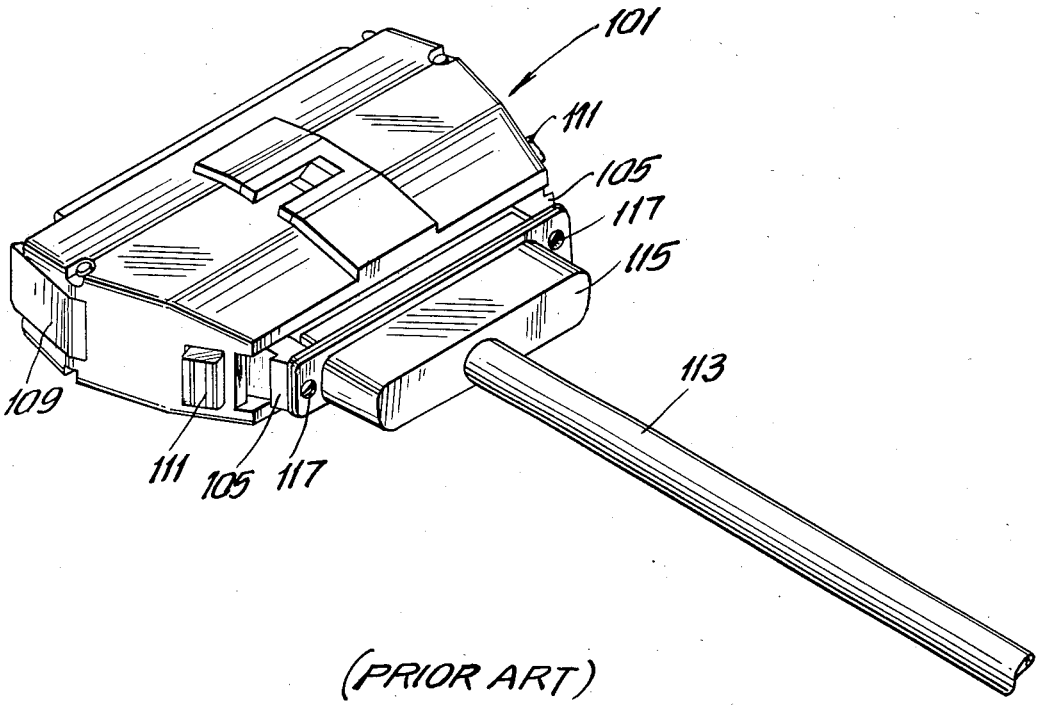
(PRIOR ART) FIG. 2
FIG. 2 is a perspective drawing of an electronic plug connector of the prior art coupled to an electronic cable portion.

It will readily be understood that with a multidirection plug connector according to the invention, a user, after orienting cable exit in accordance with his or her space and/or design requirements, can fasten the electrical plug 13 to an electronic device (not shown) such as a computer terminal or a telephone switching system, etc. The plug 13 may, for example, include pin connectors (not shown) which may be then coupled to corresponding receiving portions of an electronic device. A bracket 10 (FIG. 3) including a fastener opening 9 may be provided for the plug 13 to be associated with a matching element on the electronic device so that a fastener can secure the plug to the electronic device. Alternatively, a pair of claws, such as were illustrated at 109 in the prior art device of FIG. 1 can be provided on connector body portion 3 to allow secure but easily releasable coupling of the plug 13 to the electronic device.

It will of course be understood that the invention has wide applicability not only to electronic or electrical pulse systems in general but also to a wide variety of particular electronic systems including computer systems, A/C systems, D/C systems, fiber optic systems, etc.

In preferred embodiments of the invention, loosening of tool activated fasteners 26, such as screws, allow the screen relief portion 1 and the body portion 3 to be easily realigned. A further benefit thus achievable in apparatuses according to preferred embodiments of the invention is that alternating between the various cable exit orientations (see FIGS. 6–9, 6A–9A) is easily user adjustable.

Likewise, in preferred embodiments, the strain relief portion hemispheres 6, 8 (FIG. 3) will be secured with removable fasteners to allow easy and user adjustable movement of the cable 18 therewithin. Furthermore, because the strain relief portion 1 is clamped together in preferred embodiments using adjustable fasteners 28 (See FIG. 3), by loosening the fasteners, the user may readjust the cables' rotational orientation within the strain relief portion itself.

It will thus be readily understood that the apparatus according to the invention, which provides multi-axial cable exit, will allow close connector spacings and high connector densities on electronic backplanes and other electronic devices eliminating, to a large degree, the space and design concerns previously associated with D-type electronic connectors. Cable routing is simplified and is less space-consumptive because it exits the connector housing in a user or designer determined direction.

It is fully contemplated as well that the invention will allow for both shielded and unshielded varieties of cables, cable connectors, and plugs.

It is, of course, further fully contemplated that the invention can be made more or less adjustable or permanent with an attendant increase or decrease in user flexiblity. For example, permanent fasteners could replace adjustable and removable fasteners 26, 28 (FIG. 3) without departing from the invention.

Likewise, although in the embodiment disclosed, the body portion is adapted to receive the male strain relief portion, it is possible to provide, within the invention, an emobodiment wherein the strain relief portion is adapted to receive a male mating portion of the connector body. The profiles of the mating portions can be varied to provide a variety of orientations.

Furthermore, although the embodiments herein discussed comprise body and strain relief portions divided in hemispheres, a wide variety of connector constructions may be provided within the spirit of the invention.

Thus, although the invention has been clearly and fully described above by way of reference to the embodiments of the drawings, the specific embodiments disclosed herein should in no way be construed to limit the spirit of the invention and the scope of the claims which follow.

We claim:

1. A a multidirection connector, comprising: a body portion, a strain relief portion, said body portion having an opening for receiving said strain relief portion and locking means internal to said body portion for locking said strain relief portion in at least four orientations within said opening, said strain relief portion being rotatable through 360° within said body portion, wherein said strain relief portion includes a cable passageway and wherein said body portion includes means for retaining a connector plug, and wherein the plane formed at the intersection of said body portion and said strain relief portion is at substantially 45° to the longitudinal axis of said body portion.

2. A multidirection connector, as recited in claim 1 wherein said cable passageway provides substantially 45° of turn.

3. A multidirection connector, as recited in claim 2, wherein said locking means includes a substantially square male mating portion and a substantially square female mating portion.

4. A multidirection connector, as recited in claim 3, wherein said male mating portion includes a flange and said female mating portion includes a seat for receiving said flange.

5. A multidirection connector, as recited in claim 2, wherein said body portion may be oriented in at least two positions with respect to a connector plug.

6. A multidirection connector, as recited in claim 2, wherein said strain relief portion is substantially prism-shaped and wherein, in at least one orientation, said body portion and said strain relief portion form a rectangular unit with said strain relief portion defining one corner thereof.

7. A multidirection connector, as recited in claim 2, wherein said body portion comprises two similar half portions divided horizontally in the plane of said connector plug.

8. A multidirection connector, as recited in claim 7, wherein fastening means secure said half portions.

9. A multidirection connector, as recited in claim 7, wherein said strain relief portion comprises two similar half portions secured by fastening means.

10. A multidirection connector, comprising:

a strain relief portion including a cable passageway adapted for clamping a length of cable, said cable passageway turning substantially 45° degrees within said strain relief portion;

a body portion having two openings therein, the first of said openings being provided in the front of said body portion and being adapted to receive a connector plug and the second of said openings being provided at a rear corner of said body portion and being adapted to recieve said strain relief portion in at least four orientations respective said body portion; and locking means for locking said strain relief portion within said body portion in each of said four orientations, said locking means comprising an internal portion of said body portion and an external portion of said strain relief portion.

11. A multidirection connector, as recited in claim 10, wherein said strain relief portion is rotatable through substantially 360° within said second opening.

12. A multidirection connector, as recited in claim 11, wherein said first opening is adapted for receiving a connector plug in at least two orientations respective said body portion, such that at least seven directions of cable exit are provided respective said connector plug.

13. A multidirection connector, as recited in claim 10, wherein said four orientations provide cable exit from said cable passageway sidewards, backwards, upwards and downwards with respect to said body portion.

14. A multidirection connector, as recited in claim 13, wherein said first opening is adapted for receiving a connector plug in at least two orientations respective said body portion, such that at least seven directions of cable exit are provided respective said connector plug.

* * * * *